252-98 AU 157 EX
9/9/86 XR 4,610,796

United States Patent [19]
Chirash et al.

[11] Patent Number: 4,610,796
[45] Date of Patent: Sep. 9, 1986

[54] FABRIC SOFTENER COMPOSITION CONTAINING MOLECULAR SIEVE ZEOLITE

[75] Inventors: William Chirash, New Providence; Harold E. Wixon, New Brunswick, both of N.J.

[73] Assignee: The Colgate-Palmolive Co., New York, N.Y.

[21] Appl. No.: 762,795

[22] Filed: Aug. 2, 1985

Related U.S. Application Data

[63] Continuation of Ser. No. 659,907, Dec. 17, 1984, abandoned, which is a continuation of Ser. No. 92,846, Nov. 9, 1979, abandoned, which is a continuation of Ser. No. 785,474, Apr. 7, 1977, abandoned, which is a continuation of Ser. No. 683,973, May 6, 1976, abandoned, which is a continuation of Ser. No. 503,735, Sep. 5, 1974, abandoned.

[51] Int. Cl.[4] ..... C11D 1/62; C11D 1/65; C11D 3/12; D06M 13/46

[52] U.S. Cl. ..... 252/8.75; 252/8.8; 252/98; 252/99; 252/102; 252/113; 252/116; 252/131; 252/140; 252/155; 252/174.25; 252/179; 252/528; 252/540; 252/547; 252/559

[58] Field of Search ..... 252/8.6, 8.75, 8.8, 252/131, 140, 174.25, 179, 528, 547; 8/115.6

[56] References Cited

U.S. PATENT DOCUMENTS

| | | | |
|---|---|---|---|
| 3,325,404 | 6/1967 | Cohen | 252/8.75 |
| 3,360,470 | 12/1967 | Wixon | 252/99 |
| 3,703,480 | 11/1972 | Grand | 252/524 |
| 3,812,041 | 5/1974 | Inamorato | 252/89 |
| 3,861,870 | 1/1975 | Edwards | 252/8.6 X |
| 3,954,632 | 5/1976 | Gloss | 252/8.8 |
| 3,985,669 | 10/1976 | Krummel | 252/116 |
| 4,062,647 | 12/1977 | Storm | 8/137 |
| 4,203,852 | 5/1980 | Johnson et al. | 252/8.8 |
| 4,274,975 | 6/1981 | Corkill | 252/140 |

*Primary Examiner*—Dennis L. Albrecht
*Attorney, Agent, or Firm*—Kenyon & Kenyon

[57] ABSTRACT

The patent specification discloses a method of softening fabrics by agitating them in an aqueous medium containing (a) a heavy duty spray dried built synthetic detergent composition consisting of 10% sodium linear tridecyl benzene sulfonate, 2% of a nonionic detergent which consists of a $C_{14}$–$C_{15}$ fatty alcohol condensed with an average of 11 ethylene oxide groups per molecule, 1% of a mixed sodium coconut/tallow (20:80) fatty acid soap, 33% of pentasodium tripolyphosphate, 7% of sodium silicate wherein the ratio of $Na_2O$ to $SiO_2$ is 1:2.35, 0.5% sodium carboxymethyl cellulose, with the balance of the detergent composition being optical brighteners, about 38% sodium sulfate, and about 7% moisture;

(b) a softening composition consisting of about 20% of distearyl dimethyl ammonium chloride, about 40% of Type A synthetic sodium molecular sieve zeolite having a mean particle diameter of 5.9 to 6.4 microns and containing about 21% water, and about 40% sodium perborate;

wherein about 0.1% to about 0.3% by weight of the aqueous medium consists of (a) and (b), and the ratio of (a) to (b) is 2:1.

1 Claim, No Drawings

FABRIC SOFTENER COMPOSITION CONTAINING MOLECULAR SIEVE ZEOLITE

CROSS REFERENCE TO RELATED APPLICATIONS

This application is a continuation of Ser. No. 659,907, filed Dec. 17, 1984, abandoned, which is a continuation of Ser. No. 92,846, filed Nov. 9, 1979, abandoned, which is a continuation of Ser. No. 785,474, filed Apr. 7, 1977, abandoned, which is a continuation of Ser. No. 683,973, filed May 6, 1976, abandoned, which is a continuation of Ser. No. 503,735, filed Sept. 5, 1974, abandoned.

This invention relates to fabric softening compositions. More particularly, it relates to such compositions which are compatible with synthetic organic detergents, include a carrier material having detergent building activity and which are useful as wash cycle fabric softeners.

The use of various chemical materials, especially water soluble cationic compounds, as softeners for fabrics is well known. It is also known to employ such materials for their softening effect during laundering and particularly in the rinse cycle of the laundering operation. Use of such a softener in the rinse cycle was formerly required because the softeners heretofore employed, being mostly cationic in nature, were not thought to be compatible with the principal anionic types of detergents used in washing compositions. By far the predominating type of detergent used in home and commercial laundering has been that which contained organic anions, which products are referred to as anionic detergents. Even traces of such anionic materials often precipitate cationic softeners, thereby reducing the effectiveness of the softeners. This manifestation of incompatibility long prevented use of cationic softeners in the washing stage or cycle of the laundering operation. In other words, it necessitated use of the softener in the rinse cycle after rinses of the laundry had removed anionic detergent.

To overcome the aforementioned disadvantage and to obtain a softening agent useful in the wash cycle of the laundering process it has been proposed in U.S. Pat. No. 4,203,852 to admix the softener with a bleach and a water soluble carrier in granular or bead form. The shaped carrier is a mixture of water soluble detergency builders, such as sodium silicate and sodium carbonate, and usually also contains organic detergent, e.g., a nonionic detergent. The preparation of such carriers normally entails admixture of the foregoing ingredients in an aqueous medium, followed by a dry operation, typically spray drying. Such drying operation may involve volatilization of various organic ingredients of the carriers, such as the nonionic detergent and hence the manufacture of such prior art wash cycle softeners could entail economic losses and atmospheric pollution if anti-pollution devices for the spray dryer were not functioning adequately. Such disadvantages are overcome and a detergent-compatible fabric softening composition is provided by the present invention. The invention is directed to a fabric softening composition, preferably suitable for wash cycle use, comprising a water soluble organic (usually cationic) fabric softening agent and, usually also acting as a carrier, a particulate molecular sieve zeolite, preferably in substantially gasfree univalent cation exchanging form, usually in a weight ratio of about 1:1 to about 1:20, e.g., 1:2 to 1:6.

Preferably the ratio of cationic softener to molecular sieve zeolite is about 1:1.5 to about 1:10. Typically the percentage of the softener is 3 to 30% and that of the molecular sieve zeolite is 5 or 10 to 60%.

The fabric softening composition can be prepared by dry mixing of the solid softener in particulate form with the molecular sieve zeolite, thereby avoiding a dry operation which could produce atmospheric pollution and loss of product. Other dry components of the product may also be admixed and aqueous solutions or melts of some constituents may be sprayed onto moving surfaces of other powdered components. Spray drying or prilling operations may be used, if desired.

The present composition is compatible with anionic and nonionic detergents and with mixtures thereof and hence can be applied to fabrics using the wash cycle of conventional automatic laundering processes, without objectionable loss of softening effectiveness. If desired, a supplementary builder or filler and/or an organic detergent, and/or a bleach can be incorporated in the present softening composition to obtain a multifunctional product, effective not only as a fabric softener but also as a detergent and stain remover. In general the percentage of the organic detergent in the product will be from 0 to 30%, and preferably will be about 5 to 25%. The bleach content may usually be from 0 to 60% and is preferably about 10 to 60%. The supplementary builder content may be from 0 to 70%, preferably 10 to 50%.

The molecular sieve zeolite component of the present composition provides an excellent detergency building effect, being especially effective against calcium hardness. However, if desired the softening composition may contain additional builders such as water soluble silicates or carbonates (or even phosphates), present at about a 5 or 10 to 70%, preferably 10 to 50% and most preferably 10 to 30% level.

The present softening composition may also optionally include other conventional additives, such as inert water soluble inorganic filler salts and minor adjuvants having aesthetic or functional effects, e.g., colorants, bactericides, organic anti-redeposition agents. The filler may be 0 to 70%, preferably 30 to 70% and most preferably 30 to 55% of the product and the total of minor adjuvants usually will not exceed 25%, with the proportion of each individual adjuvant not exceeding about 10%, being typically in the range of about 0.01 to 5%.

The cationic fabric softening compounds useful in the composition of the present invention are commercially known and comprise cationic nitrogen-containing compounds, such as quaternary ammonium compounds and amine salts containing one or two straight chain organic radicals of at least 8 carbon atoms and preferably containing at least one straight chain organic radical containing from 12 to 22 carbon atoms.

The preferred softening agents are quaternary ammonium softening agents of the following formula:

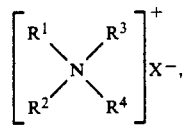

wherein $R^1$ is a long chain aliphatic radical having from 8 to 22 carbon atoms, $R^2$ is a long chain aliphatic radical having from 8 to 22 carbon atoms or a lower alkyl radical having from 1 to 6 carbon atoms or an aryl, aryloxy, alkoxy or aralkyl radical of 6 to 28 carbon atoms, $R^3$ and $R^4$ are lower alkyl or hydroxyalkyl radicals having from 1 to 6 carbon atoms or hydroxypolyalkoxy alkyl radicals having from 4 to 20 carbon atoms, and X is a water soluble salt-forming anion, such as a halide (chloride, bromide, iodide), sulfate, acetate, hydroxide, or similar inorganic solubilizing monobasic or dibasic radical. Additionally, the nitrogen may be a ring nitrogen, with $R^2$ and $R^3$ being replaced by 4 to 5 carbon atoms in a ring. Compounds of the formula wherein $R^1$, $R^2$, $R^3$ and $R^4$ each represent a straight chain aliphatic radical, such as alkyl, yield especially good results. Examples of quaternary ammonium softening agents within the formula which are suitable for use in the composition of the present invention include the following: hydrogenated di-tallow dimethyl ammonium chloride; ethoxylated distearyl dimethyl ammonium chloride; dimethyl distearyl ammonium chloride; trimethyl stearyl ammonium bromide; cetyl trimethyl ammonium chloride, di-coco dimethyl ammonium chloride; cetyl pyridinium chloride; higher alkyl dimethyl benzyl ammonium chloride; diisobutyl phenoxy ethoxy ethyl dimethyl benzyl ammonium chloride; lauryl isoquinolinium bromide; distearyl dimethyl ammonium bromidep; distearyl dimethyl ammonium methosulfate; di-coco dimethyl ammonium chloride; dimethyl-diarachidyl behenyl ammonium chloride; di(soya)dimethyl ammonium chloride; and stearyl dimethyl benzyl ammonium chloride.

Also useful are softening agents of the formula:

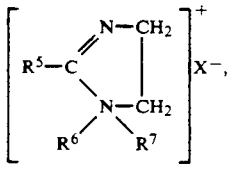

wherein $R^5$ is a long chain aliphatic radical having from 8 to 22 carbon atoms, $R^6$ is a lower alkyl radical having from 1 to 6 carbon atoms, $R^7$ is a higher alkyl amidoalkyl radical having from 8 to 22 carbon atoms or a hydroxyalkyl radical having from 2 to 6 carbon atoms. Examples thereof include 2-heptadecyl-1-methyl-1[(2-stearylamido)ethyl]imidazolinium methyl sulfate and 2-heptadecyl-1 methyl-1-hydroxyethyl imidazolinium chloride.

Examples of amines which may be utilized in the forms of their water soluble salts in the composition of the present invention include primary tallow amine, primary coco amine, primary hydrogenated tallow amine, tallow 1,3-propylene diamine, oleyl 1,3-propylene diamine, and coco 1,3-propylene diamine. The most useful water soluble salts of the aforementioned amines are exemplified by the sulfate, hydrogen sulfate and chloride. The term "coco", when utilized, refers to fatty acid groups present in coconut oil fatty acids. Such acids contain from about 8 to 18 carbon atoms per molecule, with the $C_{12-14}$ acids predominant.

The molecular sieves utilized in the invented compositions are water insoluble crystalline aluminosilicate zeolites of natural and synthetic origin which are characterized by having a network of similarly or substantially uniformly sized pores in the range of about 3 to 10 Angstroms, which size is uniquely determined by the unit structure of the zeolite crystal. Of course, zeolite molecular sieves containing two or more such networks of different size pores may also be employed and non-crystalline zeolites have found use too, at least as a part of the total zeolite molecular sieve content.

The molecular sieve zeolite should also be a univalent cation exchanging zeolite. That is, it should be an aluminosilicate having in its structure a univalent cation such as sodium, potassium, lithium (in suitable cases) or other alkali metal, or ammonium. Preferably, such univalent cation is an alkali metal cation and sodium and potassium are most preferred.

Among the useful zeolites are those of the following crystal structure types: A, X, Y, L, mordenite, chabazite and erionite. Mixtures of these and equivalent molecular sieve zeolites can also be used.

These preferred crystalline structure types of molecular sieve zeolites are well known in the art and are more particularly described in the text *Zeolite Molecular Sieves* by Donald W. Breck, published by John Wiley & Sons in 1974. Readily available commercial forms of the preferred molecular sieve zeolites are described in Table 9.6 of the Breck text at pages 747–749, which table is hereby incorporated by reference. Preferably the molecular sieve zeolite used in the invention is a synthetic molecular sieve zeolite. Preferably also the zeolite is one having a type A crystal structure, more particularly described on page 133 of the aforementioned Breck reference, and the pore size (nominal) thereof is about 4 Angstroms. The especially preferred zeolite molecular sieves are described in U.S. Pat. No. 2,882,243 which refers to them as Zeolite A. However Types X and Y are also very useful.

Molecular sieve zeolites can be prepared in either a dehydrated or calcined form, which contains no more than about 0 to 3% of moisture, usually 1 to 3%, or in a hydrated or water loaded form, which contains additional adsorbed water in an amount up to about 36% of the zeolite, depending on the type of zeolite used, e.g., 4 to 30%. Preferably the water-containing hydrated form of the molecular sieve is employed in this invention. If the anhydrous form is used it soon picks up water and becomes hydrated. The manufacture of such zeolite molecular sieve crystals is well known in the art. For example, in the preparation of zeolite A, referred to above, the hydrated zeolite crystals that are formed in the crystallization medium (such as a hydrous amorphous sodium aluminosilicate gel) are used without the high temperature dehydration (calcining to about 1 to 3% water content) that is normally practiced in preparing such crystals for use as catalysts, e.g, cracking catalysts. The preferred form of zeolite is either completely hydrated or partially hydrated form can be recovered by filtering off the crystals from the crystallization medium and drying them in air at ambient temperature so that their water content is in the range of about 20–28.5%, preferably about 20 to 22%.

The crystalline zeolites used in the invented compositions may be substantially free of adsorbed gases, such as carbon dioxide, which may produce foaming on contact with water. Of course, when foaming is desired such gas-containing sieves are not usually objectionable and may be preferred. Preferably the molecular sieve should be in finely divided condition, such as crystals having mean particle diameters in the range of about 0.5 to about 12 to 13 microns, preferably 5 to 9 microns.

The water soluble organic detergent which may be incorporated in the present composition is advantageously an anionic or nonionic detergent, with anionic detergents sometimes being preferred because of their normally stronger detersive effects. However, the nonionics are usually more compatible with the softening agents. The aforementioned categories of organic detergents are described and exemplified in McCutcheon's *Detergents and Emulsifiers* 1969 Annual (wherein such compounds are listed by chemical formulae and trade names) and in *Surface Active Agents and Detergents,* Vol. II, by Schwartz, Perry and Berch (Interscience Publishers, 1958).

Suitable anionic detergents include higher (10 to 20 carbon atom) alkyl benzene sulfonate salts wherein the alkyl group preferably contains 10 to 16 carbon atoms. The alkyl group especially preferred is a linear alkyl radical of about 11 to 13 or 11 to 14 carbon atoms. Desirably, the alkyl benzene sulfonate has a higher content of 3-(or higher)phenyl isomers and a corresponding low content (well below 50%) of 2-(or lower)phenyl isomers; in other terminology the benzene ring is preferably attached in large part at the 3 or higher (e.g., 4, 5, 6 or 7) position of the alkyl group and the content of isomers in which the benzene ring is attached at the 2 or 1 position is correspondingly low. One suitable type of such detergent is described in U.S. Pat. No. 3,320,174.

Also useful anionic detergents are olefin sulfonate salts. Generally they contain long chain alkenyl sulfonates or long chain hydroxyalkane sulfonates (with the OH being on a carbon atom which is not directly attached to the carbon atom bearing the $—SO_3$ group). More usually, the olefin sulfonate detergent comprises a mixture of these two types of compounds in varying amounts, often together with long chain disulfonates or sulfate-sulfonates. Such olefin sulfonates are described in many patents, such as U.S. Pat. Nos. 2,061,618; 3,409,637; 3,332,880; 3,420,875; 3,428,654; 3,506,580; and British Pat. No. 1,139,158, and in the article by Baumann et al. in Fette-Seifen-Anstrichmittel 72, No. 4, pp. 247–253 (1970). All the above-mentioned disclosures are incorporated herein by reference. The olefin sulfonates are usually of 12 to 18 carbon atoms per molecule.

Another useful class of water soluble organic anionic detergents is that of the higher (10 to 20 carbon atoms), paraffin sulfonates. These may be the primary paraffin sulfonates, made by reacting long chain alpha olefins and bisulfites, e.g., sodium bisulfite, or paraffin sulfonates having the sulfonate groups distributed along the paraffin chain, such as the products made by reacting a long chain paraffin with sulfur dioxide and oxygen under ultraviolet light followed by neutralization with NaOH or other suitable base, as in U.S. Pat. Nos. 2,503,280; 2,507,088; 3,260,741; and 3,372,188 and German Pat. No. 735,096. The hydrocarbon substituent of the paraffin sulfonate preferably contains 13 to 20 carbon atoms. The paraffin sulfonate will normally be a monosulfonate but, if desired, may be a di-, tri- or higher sulfonate. Typically, a paraffin disulfonate is used in admixture with the corresponding monosulfonate, for example as a mixture of mono- and di-sulfonates containing up to about 30% of the disulfonate.

The hydrocarbon substituent of the paraffin sulfonate will usually be linear but branched chain paraffin sulfonates can be employed. The paraffin sulfonate used may be terminally sulfonated or the sulfonate substituent may be joined to the 2-carbon or other carbon atom of the paraffin chain. Similarly, any di- or higher sulfonate employed may have the sulfonate groups distributed over different carbons of the hydrocarbon chain.

Other anionic detergents are water soluble salts of, for instance, such high fatty carboxylic acids as lauric, myristic, stearic, oleic, isostearic, palmitic, undecylenic, tridecylenic, pentadecylenic, 2-lower alkyl higher alkanoic (such as 2-methyl tridecanoic, 2-methyl pentadecanoic or 2-methyl heptadecanoic) or other saturated or unsaturated fatty acids of 10 to 20 carbon atoms or mixtures thereof. Soaps of dicarboxylic acids may also be used, such as the soaps of dimerized linoleic acid, and the soaps of the other higher molecular weight acids such as resin or tall oil acids, e.g., abietic acid. A specific suitable soap is the sodium soap of a mixture of tallow fatty acids and coconut oil fatty acids, preferably in 85:15 ratio.

Other anionic detergents useful in the practice of this invention are sulfates of higher alcohols, such as sodium lauryl sulfate, sodium tallow alcohol sulfate and other sulfated oils or sulfates of mono- or diglycerides of higher fatty acids, e.g., stearic monoglyceride monosulfate; higher alkyl poly-(lower alkenoxy)ether sulfates, [the sulfates of the condensation products of a lower (2 to 4 carbon atoms) alkylene oxide, e.g., ethylene oxide, and a higher aliphatic alcohol, e.g., lauryl alcohol], wherein the molar proportion of alkylene oxide to alcohol is from about 1:1 to 5:1; lauryl or other higher alkyl glyceryl ether sulfonates; and aromatic poly-(lower alkenoxy)ether sulfates, such as the sulfates of the condensation products of ethylene oxide and nonyl phenol (usually having 1 to 20 oxyethylene groups per molecule, preferably 2–12). The ether sulfate may also be one having a lower alkoxy (of 1 to 4 carbon atoms, e.g., methoxy) substituent on a carbon close to that carrying the sulfate group, such as a monomethyl ether monosulfate of a long chain vicinal glycol, e.g., a mixture of vicinal alkanediols of 16 or 17 to 18 or 20 carbon atoms in a straight chain.

Additional useful water soluble anionic detergents include the higher acyl sarcosinates, e.g., sodium lauroyl sarcosinate; the acyl esters, e.g., oleic ester, of isethionates; and acyl N-methyl taurides, e.g., potassium N-methyl lauroyl- or oleyl tauride. Another type of anionic detergent is a higher alkyl phenol sulfonate, for example, a higher alkyl phenol disulfonate, such as one having an alkyl group having some 12 to 25 carbon atoms, preferably a linear alkyl of about 16 to 22 carbon atoms, which may be made by sulfonating the corresponding alkyl phenol to produce a product containing in excess of 1.6, preferably above 1.8, e.g., 1.8 to 1.9 or 1.95 $SO_3H$ groups per alkyl phenol molecule. The disulfonate may be one whose phenolic hydroxyl group is blocked, as by etherification or esterification; thus the H of the phenolic OH may be replaced by an alkyl, e.g., ethyl, or hydroxyalkoxyalkyl, e.g., $—(CH_2CH_2O)_xH$ group, in which x is one or more, such as 3, 6 or 10; and the resulting alcoholic OH may be esterified to form a sulfate, e.g., $—SO_3Na$.

While the aforementioned structural types of organic carboxylates, sulfates, and sulfonates are generally preferred types of anionic detergents, the corresponding organic phosphates and phosphonates are also useful as anionic surfactants. The sulfates and sulfonates are preferred.

Generally, the water soluble anionic organic detergents are alkali metal salts, such as potassium, lithium, and especially sodium salts, although ammonium salts and substituted ammonium salts derived from lower (2 to 4 carbon atoms) alkanolamines, e.g., methylamine, ethylamine, sec-butyl amine, dimethylamine, tripropylamine and triisopropylamine, are also useful.

The nonionic surfactants having the most desirable properties for use in the softener compositions are usually inherently unctuous pasty or tacky solids at room temperature, such as those having melting points below about 40° C. and having significant volatility under commercial spray drying conditions. They may be liquids which can be "solidified" into flowable particles by spraying onto particulate solids, such as the zeolites Typical nonionic detergents are poly(lower alkenoxy) derivatives that are usually prepared by the condensation of a lower (2 to 4 carbon atom) alkylene oxide, e.g., ethylene oxide, propylene oxide, with compounds having a hydrophobic hydrocarbon chain and containing one or more active hydrogen atoms, such as higher alkyl phenols, higher fatty alcohols, higher fatty acids, higher fatty mercaptans, higher fatty amides and polyols, e.g., fatty alcohols having a 8 to 20, typically 10 to 18 carbon atom alkyl chain and alkoxylated with an average of about 3 to 20, typically 5 to 15 alkylene oxide units. Commercially available nonionic surfactants falling into this category are Neodol 45-11, which is an ethoxylation product (having an average of about 11 ethylene oxide units per molecule) of a 14 to 15 carbon chain fatty alcohol (Shell Chemical Company); Neodol 25-7, a 12 to 15 carbon chain fatty alcohol ethoxylated with an average of about 7 ethylene oxide units; Alfonic 1618-65, which is a 16 to 18 carbon atom alkanol ethoxylated with an average of 10 to 11 ethylene oxide units (Continental Oil Company); and Pluronic B-26, a 12 to 13 carbon atom alcohol etherified with ethylene oxide and propylene oxide (BASF Chemical Company).

Preferably, the detergent incorporated in the present softening composition is an anionic detergent, especially an organic sulfonate salt detergent, for best detergency. An especially good result is generally obtained using as the detergent an alkali metal salt of a linear higher alkyl benzene sulfonate having 10 to 16 carbon atoms in the alkyl groups. However, the polyethoxylated higher fatty alcohols are also excellent and may be used in place of or together with the described anionic compounds.

Another important optional ingredient of the instant softening composition is a bleach. The bleach may be an organic bleaching agent such as N-bromo- and N-chloro-compounds, for example di- and tri-chloro-(or bromo)cyanuric acids and water soluble salts thereof. Preferably however, the bleach is inorganic and is most preferably an inorganic peroxygen compound, such as a perborate, percarbonate, perphosphate, persilicate, persulfate, hydrogen peroxide, alkali metal peroxide or similar compound. Desirably those of the foregoing bleaching agents which are salts are charged in the form of a water soluble salt, preferably an alkali metal salt and especially a sodium salt. Good results are obtained using sodium perborate or sodium percarbonate as the bleach.

The present fabric softening composition may also contain an inert water soluble inorganic salt as a filler. Typical examples of such filler salts include alkali metal halides, such as sodium chloride or alkali metal sulfates, such as sodium sulfate. Sodium sulfate, particularly anhydrous sodium sulfate, is preferred. The softening composition may also contain a small amount of moisture in addition to that which may be adsorbed within the zeolite molecular sieve. Generally, such moisture does not exceed 10% of the composition and typically is only about 0.1 to 4 or 5%.

The water insoluble molecular sieve zeolite of the present fabric softening compositions has an excellent building effect on organic detergents (such as sodium linear higher alkyl benzene sulfonates) which are charged to the washing machine for use in the wash cycle and also builds such detergents which may be incorporated in the softening compositions. However, if desired, water soluble builders may be added to the softening composition to supplement the building action of the molecular sieve zeolite. The supplementing builder salts may be either organic or inorganic salts. Representative organic builder salts include the water soluble salts of nitrilotriacetic acid, citric acid, 2-hydroxyethylene, iminodicarboxylic acid, boroglucoheptanoic acid, and polycarboxylic acids, e.g., polymaleates of low molecular weight (generally below 1,000, e.g., 400, 600, or 800). Representative inorganic builder salts include borax, alkali metal silicates, e.g., sodium silicates, having an $Na_2O:SiO_2$ ratio in the range of 1:1.5 to 1:3.2, and preferably 1:2 to 1:2.5, alkali metal polyphosphates, such as pentasodium tripolyphosphate and tetrasodium pyrophosphate (although these are often omitted for ecological reasons) and alkali metal carbonates, such as sodium carbonate.

The supplementary builder is preferably an inorganic salt. An especially desirable water soluble inorganic builder salt is sodium silicate, which is particularly effective in sequestering magnesium cation and thus is useful in overcoming water hardness not counteracted by the molecular sieve, which is most effective against calcium. Sodium silicate of an $Na_2O:SiO_2$ molar ratio of about 1:2.35 yields excellent building results in the present softener compositions.

The minor adjuvants which are optionally incorporated into the present softening compositions to provide particular aesthetic and functional effects include colorants, such as water insoluble inorganic pigments, e.g., Ultramarine Blue, water insoluble organic pigments, e.g., Indanthrene Blue R. S. and water soluble organic dyes, e.g., Color Index Direct Blue 1. The adjuvant colorant may also be one of the fluorescent dyes known in the art as optical brighteners. Such brighteners may be coumarins, triazolyl stilbenes, stilbene cyanurics, acylamino stilbenes or miscellaneous types such as shown in U.S. Pat. Nos. 2,911,514 and 3,031,460. The proportion of brightener is usually quite small, e.g., in the range of about 1/20% to 1%, preferably 1/10% to ½%. One suitable combination of brighteners includes a naphthotriazole stilbene sulfonate brightener, sodium 2-sulfo-4-(2-naphtho-1,2-triazolyl)stilbene, another stilbene brightener, bis(anilino diethanolamino triazinyl)-stilbene disulfonic acid, another stilbene brightener, sodium bis(anilino morpholino triazinyl)stilbene disulfonate, and an oxazole brightener, having a 1-phenyl 2-benzoxazole ethylene structure, 2-styryl naphtha[1,2-d]oxazole, in relative proportions of about 1:1:3:1.2.

Among the minor adjuvants may also be an organic anti-redeposition agent, such as the alkali metal salts of carboxymethyl cellulose, e.g., sodium carboxymethyl cellulose, polyvinyl alcohol, hydoxymethyl ethyl cellulose, polyvinyl pyrrolidone, polyacrylamide, hydroxypropyl ethyl cellulose or mixtures thereof. Preferably the anti-redeposition agent added is sodium carboxymethyl cellulose.

Other important minor adjuvants which may be incorporated in the softening compositions and softening-detergent compositions of the invention include perfumes; fungicides or preservatives such as polyhalosalicylanilides, e.g., tetrachlorosalicylanilide; sanitizers, e.g., trichlorocarbanilide; foam destroyers, such as silicones; enzymes, e.g., the subtilisin protease sold as Alcalase; and flow improving agents such as the clay product commercially sold to the detergent industry under the trade name of Satintone.

The softening composition of the invention will generally be made and used as a powder. However, if desired, the particulate composition of the invention can be compressed in a conventional manner to obtain a tablet. Alternatively, the present invention can be converted to a fluid paste by addition of up to about an equal weight of water and subsequent thorough agitation of the resultant mixture. Addition of more water converts it to a liquid but the insoluble molecular sieve may settle out, requiring shaking before use.

The invented softening composition not only softens fabrics but also reduces or eliminates static cling of the fabrics. The molecular sieve zeolite acts as a carrier for the softening composition and is a highly effective detergency builder; in other words it boosts the cleaning effect of detergent compositions in which it is incorporated or with which it is used. The molecular sieve zeolite carrier is highly efficient in sequestering calcium ion when the present composition is used in wash water of high calcium hardness. Accordingly at a conventional 0.01 to 0.1% concentration of softener composition (on a softening agent+molecular sieve basis) or a 0.1 to 0.3% concentration of the softener-detergent, the invented compositions significantly promote detersive action, even at calcium ion concentrations of 50 to 200 p.p.m. as $CaCO_3$, or higher. Thus, additions of the molecular sieve and softener to wash cycles in which separate detergent composition is present results in noticeable increases in detergency and building action.

The fabric softener-molecular sieve zeolite compositions may also include a bleach and/or an organic detergent, and thereby become highly effective multi-functional laundry treatment products capable not only of imparting softening and anti-cling characteristics to laundry but also of cleaning and bleaching out stains and spots.

The present softening compositions, optionally containing detergent and/or bleach have found their greatest utility in the multi-functional treatment of cotton fabrics, fabrics made of other cellulosic fabrics, e.g., rayon, or other textile fibers, e.g., nylon, silk, wool, polyethylene terephthalate, cellulose acetate, acrylonitrile polymers or copolymers or blends of any two or more of these fibers, e.g., cotton-polyester blends. The present detergent-containing compositions are especially effective in removing clay and carbon soils, skin soil, natural and artificial sebum soils, particulate soils, etc.

The softening compositions of the invention may be applied to laundry in an aqueous bath either during the wash cycle of laundering or as a separate and distinct softening treatment. Since the present fabric softener compositions are compatible with anionic and nonionic detergents they are preferably added to the washing cycle in the laundering process. Normally about 25 to 100 g. preferably about 60 g. of the softening composition, corresponding to about 1 to 40 g. of softening agent, preferably 3 to 30 g., e.g., 10 g., are added to an automatic washing machine or similar washing apparatus containing 17 gallons (35 liters) of water and an average load of laundry (about 5 to 10 pounds) for washing at a temperature of 20° to 70° C., e.g., about 50° C., over 5 minutes to 45 minutes. However, lesser or greater amounts may be utilized to obtain the desired degree of softness, whiteness, and anti-static properties depending on the water temperature, the water hardness, (hardnesses of 20 to 200 p.p.m. $CaCO_3$ are common), the amounts of water and laundry, etc.

It was surprising to discover that in use of the present softening composition containing a water insoluble carrier and builder, and nolecular sieve zeolite, only a slight, almost imperceptible amount of the molecular sieve zeolite remained as residue on the treated, rinsed laundry and even this usually disappears in normal machine tumble drying. The molecular sieve zeolite acts as a carrier, flow improving agent, builder, disperser, extender and possibly, stabilizer for the softening composition components and is compatible with them. Additionally, it is non-eutrophic, non-polluting, biologically safe and effective. Furthermore it can hold water and hardness ions and thus prevent undesirable tackiness in the product and inactivation of the detergent. Finally, it lends itself to easy and non-polluting manufacturing techniques which require little capital investment and little energy consumption.

The following examples illustrate the invention but do not limit it. Unless otherwise noted all parts, percentages and proportions are by weight and all temperatures are in °C.

EXAMPLE 1

| | % |
|---|---|
| Fabric softening agent (1) | 20 |
| Molecular sieve zeolite (2) | 40 |
| Sodium perborate | 40 |

(1) Distearyl dimethyl ammonium chloride, 94% active ingredient (Arosurf TA-100, manufactured by Ashland Oil Co.)

(2) A type A synthetic sodium molecular sieve zeolite having a mean particle diameter of 5.9 to 6.4 microns and containing about 21% water (Henkel & Cie., type A, nominal pore size of about 4 Å.). Proportions of molecular sieve zeolites given in this and the following example are on an anhydrous basis.

The above ingredients are mixed together in the dry state. Fifty grams of the resulting particulate fabric softening composition are added during the wash cycle of an automatic washing machine wherein two white terrycloth towels are being laundered at 50° C. in 35 liters of water of 100 p.p.m. calcium hardness, as $CaCO_3$, with 100 g. of a conventional heavy duty spray dried built synthetic detergent composition containing 10% sodium linear tridecyl benzene sulfonate, 2% of nonionic detergent (a $C_{14}$–$C_{15}$ fatty alcohol condensed with an average of 11 ethylene oxide groups per molecule), 1% of mixed sodium coconut/tallow (20:80) fatty acid soap, 33% of pentasodium tripolyphosphate, 7% of sodium silicate ($Na_2O:SiO_2=1:2.35$), 0.5% sodium carboxymethyl cellulose, with the balance of the detergent composition being optical brighteners, sodium sulfate (about 38%) and moisture (about 7%). After thorough air drying of the washed and rinsed towels, they are rated for softness on a numerical scale of 1 to 10 wherein 1 represents no softness and 10 represents excellent softness. Both towels are rated 10, indicative of the exceptional softness imparted by the softening composition and of the compatibility of the present softening composition with the anionic and nonionic detergents used in the laundering process. The towels are not only clean but also are desirably white in appearance. Careful inspection of the towels reveals only a slight, almost unnoticeable deposit of the particulate molecular sieve zeolite and this is lost when they are machine dried.

The foregoing laundering process is repeated, using the same conditions and concentrations except that the above softening composition is applied to the towels after the wash cycle, following complete removal by rinsing of the detergent. The rinsed and dried towels have substantially the same excellent degree of softness, whiteness and little or no residue. In the above described softening bleach composition similar results are obtained when the perborate bleach is replaced by sodium percarbonate. Also, replacement of the molecular sieve with a type X, Y or L sieve or with mixtures of these or mixtures with a type A sieve gives the same type of results, as does replacement of the anionic detergent with an olefin sulfonate or a paraffin sulfonate.

EXAMPLE 2

| | % |
|---|---|
| Fabric softening agent (as in Example 1) | 5 |
| Molecular sieve zeolite (as in Example 1) | 30 |
| Sodium sulfate | 53 |
| Anionic detergent (1) | 12 |

(1) Linear dodecyl benzene sulfonate (85% active, Witco Chemical Co.)

The above ingredients are mixed together in the dry state to obtain a free flowing detergent-softener powder. Fifty and one hundred grams of the resultant powder are used in separate experiments to wash two terrycloth towels in an automatic washing machine at 50° C., employing 35 liters of tap water (of about 100 p.p.m. $CaCO_3$ hardness). After rinsing and air drying the towels are rated for softness, as in Example 1 and are both rated 10+, as being of exceptional softness. The towels are not only exceptionally clean but also contain only a slight deposit of molecular sieve zeolite particles, which is removable by tumble drying.

In a control experiment two terrycloth towels are washed according to the foregoing procedure using a softener-detergent composition which is identical to that described above except that the molecular sieve zeolite builder-carrier component is replaced by sodium tripolyphosphate. The softness ratings of both rinsed and dried towels in the control experiment are only 8, indicative of the superiority of the fabric softening compositions containing molecular sieve zeolites.

In the above described fabric softening-detergent composition substantially similar results are obtained if part of the anionic detergent, e.g., 2%, based on the weight of the entire composition, is replaced by a nonionic detergent, for example, a linear $C_{14}$–$C_{15}$ fatty alcohol condensed with an average of 11 ethylene oxide groups per molecule. Also if desired, a portion, e.g., 15%, of the filler may be replaced by a supplementary builder such as sodium silicate of $Na_2O:SiO_2$ ratio of 1:2.35. If desired, the composition may also contain small proportions, e.g., 0.5% each, of such conventional adjuvants as sodium carboxymethyl cellulose (an anti-redeposition agent) and perfume. Such products have the same good performance characteristics as were reported on the experimental softener composition.

EXAMPLE 3

In the foregoing two examples substantially similar excellent results are obtained when the molecular sieve zeolite carrier is replaced by a type A sodium molecular sieve zeolite having a mean particle diameter of 8.3 microns (Linde Type 4A molecular sieve, Union Carbide Corp.). Also, where components are changed in kind or proportion, as described in the foregoing specification, excellent softening and detergency-softening results and laundry washed is soft and static-free. Bleaching effects of the per-compounds are improved by the presence of an activator to promote decomposition of the per-compound in the wash water or by raising the washing temperature to in excess of 70° C.

The invention has been described with respect to working examples and illustrations thereof but is not to be limited to these because it is evident that one of skill in the art with access to the present specification will be able to employ substitutes and equivalents without departing from the spirit or scope of the invention.

What is claimed is:

1. A method of softening fabrics which comprises agitating said fabrics in an aqueous medium containing (a) a heavy duty spray dried built synthetic detergent composition consisting of 10% sodium linear tridecyl benzene sulfonate, 2% of a nonionic detergent which consists of a $C_{14}$–$C_{15}$ fatty alcohol condensed with an average of 11 ethylene oxide groups per molecule, 1% of a mixed sodium coconut/tallow (20:80) fatty acid soap, 33% of pentasodium tripolyphosphate, 7% of sodium silicate wherein the ratio of $Na_2O$ to $SiO_2$ is 1:2.35, 0.5% sodium carboxymethyl cellulose, with the balance of the detergent composition being optical brighteners, about 38% sodium sulfate, and about 7% moisture;

(b) a softening composition consisting of about 20% of distearyl dimethyl ammonium chloride, about 40% of Type A synthetic sodium molecular sieve zeolite having a mean particle diameter of 5.9 to 6.4 microns and containing about 21% water, and about 40% sodium perborate;

wherein about 0.1% to about 0.3% by weight of the aqueous medium consists of (a) and (b), and the ratio of (a) to (b) is 2:1.

* * * * *